US009531108B2

(12) United States Patent
Bazayev

(10) Patent No.: US 9,531,108 B2
(45) Date of Patent: Dec. 27, 2016

(54) TAMPER RESISTANT RECEPTACLE WITH ROCKER MECHANISM

(71) Applicant: Hubbell Incorporated, Shelton, CT (US)

(72) Inventor: Edward Robert Bazayev, Kew Gardens, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/856,893

(22) Filed: Sep. 17, 2015

(65) Prior Publication Data

US 2016/0087369 A1 Mar. 24, 2016

Related U.S. Application Data

(60) Provisional application No. 62/054,103, filed on Sep. 23, 2014.

(51) Int. Cl.

| | |
|---|---|
| ***H01R 13/44*** | (2006.01) |
| ***H01R 13/453*** | (2006.01) |
| *H01R 24/78* | (2011.01) |

(52) U.S. Cl.
CPC ..... *H01R 13/4534* (2013.01); *H01R 24/78* (2013.01)

(58) Field of Classification Search
CPC ..... H01R 13/4534; H01R 13/6397; H01R 13/652; H01R 13/453; H01R 13/639; H01R 25/00; H01R 25/006; H01R 24/78
USPC ..... 439/137
See application file for complete search history.

(56) References Cited

U.S. PATENT DOCUMENTS

| | | | | |
|---|---|---|---|---|
| 4,379,607 A * | 4/1983 | Bowden, Jr. | ..... | H01R 13/4534 439/137 |
| 7,645,148 B2 * | 1/2010 | Carbone | ..... | H01R 13/4534 439/137 |
| 2013/0295788 A1 * | 11/2013 | Baldwin | ..... | H01R 13/4534 439/137 |

* cited by examiner

*Primary Examiner* — Javaid Nasri
(74) *Attorney, Agent, or Firm* — Michael Best & Friedrich, LLP

(57) ABSTRACT

A tamper resistant receptacle having a spacer-shutter assembly including a rocker that requires simultaneous insertion of the hot and neutral tines of an electrical plug in order to slide shutters into the open position.

6 Claims, 5 Drawing Sheets

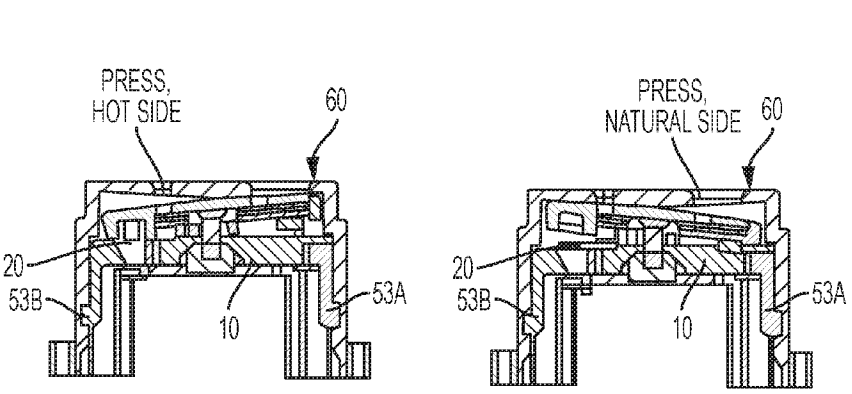
SECTION E-E
SCALE 2 : 1
FIG. 5B
SECTION F-F
SCALE 2 : 1
FIG. 5C
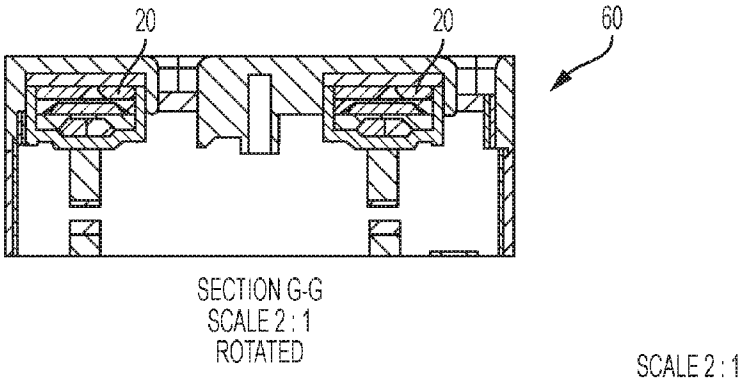
SECTION G-G
SCALE 2 : 1
ROTATED
SCALE 2 : 1
FIG. 5D
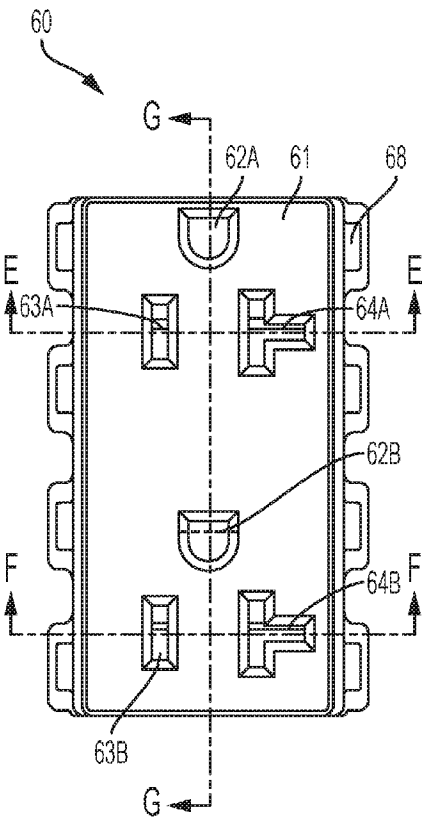
FIG. 5A

TAMPER RESISTANT RECEPTACLE WITH ROCKER MECHANISM

CROSS-REFERENCE TO RELATED APPLICATIONS

The present application claims the benefit of priority under 35 U.S.C. §119(e) to U.S. Provisional Application No. 62/054,103 filed Sep. 23, 2014, the contents of which are hereby incorporated by reference in their entirety.

FIELD OF THE INVENTION

The present invention relates to tamper resistant electrical receptacles. More particularly, the present invention relates to tamper resistant electrical receptacles using laterally sliding shutters spring biased to block access to the device's electrical contacts.

BACKGROUND OF THE INVENTION

Tamper resistant receptacles are known in the art. "Tamper Resistant" or "TR" receptacles are a class of electrical receptacle outlets configured to deny access to the device's electrical contacts unless force is applied simultaneously to both the hot and neutral plug openings of the device pursuant to NEC Code 406.11 et seq. The Code and related regulatory requirements provide that not only must the outlet openings remain blocked unless force is applied to both openings at the same time, but also that any foreign object 1/32 inch or larger, must be prevented from bypassing the blocking member of a plug opening.

As will be appreciated, these requirements were enacted in response to the phenomena of small children curiously inserting a small toy or metal object into the hot or neutral opening of a receptacle and suffering electrical shock, burns, or even death.

In meeting the standard and providing the level of protection sought from these devices, the art has gravitated towards a configuration of receptacles utilizing cooperating shutter members to block access beyond the faceplate openings of the outlet. Specifically, to ensure that force directed into only one of the two blade openings is prevented from reaching the electrical contact that lies beneath, a sliding shutter mechanism is spring-biased into a position blocking (or "shuttering") the blade opening from underneath the faceplate. The shutter physically prevents an object entering the blade opening from reaching the electrical contact below that shutter. In order to allow the shutter of a respective blade opening to be uncovered, the spring-bias must be overcome by a camming action caused by the other plug blade during insertion in the other blade opening.

To this end, the most common prior art configuration of a TR receptacle includes a shutter assembly comprising a pair of cooperating shutters. Each of the shutters includes a blocking portion positioned below a respective one of the blade openings blocking access to the contacts. Each of the shutters also includes a cam portion that extends to the opposite blade opening that receives contact from a plug blade and translates the vertical force of a plug blade and camming action into a lateral sliding displacement of the blocking portion. Thus, force by vertical insertion of a plug-blade on the neutral blade opening will move the shutter from obstructing access to the electrical contact below the hot blade opening, and vice versa. Specifically, for example, during insertion of a plug, the neutral blade tine will cam against and past the shutter cam surface forcing the shutter cam arm to move laterally, thereby overcoming the spring bias of the shutter and causing the hot blade shutter blocking portion to slide into a position away from and revealing the electrical contact beneath the hot blade opening. Likewise, force on the hot blade opening will contact the cam surface and allow the blade to cam past and move the arm and compress the spring to move the shutter blocking portion that covers the neutral blade opening out of the way. As will be appreciated, with this configuration, when a child tries to insert a toy into either opening of the outlet, the blocking portion of the shutter remains immobile from the spring bias of the opposite shutter and prevents the child from reaching the electrical contact. However, when both blades of an electrical plug contact the shutters simultaneously, the simultaneous force and camming action allows both blades to continue their downward insertion by simultaneously sliding respective shutter blocking portions laterally out of the way of the electrical contacts of the opposite shutter until the blades cam past the shutters and are able to properly "plug in" to the outlet's internal face contacts.

Existing prior art TR receptacle designs and their operational details are available in U.S. Pat. No. 4,379,607 to Bowden, Jr.; U.S. Pat. Nos. 7,645,148 to Carbone et al.; and U.S. Publ. No. 2013/0295788 to Baldwin, et al. and the references cited therein, the entire contents of which are hereby incorporated by reference in their entirety.

The proliferation of these important safety devices has led to an appreciation of the issues affecting their effective life span. A presently appreciated issue recognized by the present inventors stems from the sharpness of plug blades being found on electrical products imported from overseas. As will be appreciated, during insertion of the plug blades into the outlet face openings, the vertical force of the incoming blades has the same point of contact on the cam surface. The cam surface of most prior art devices is an inclined "ramp" of about 45° that is of a length sufficient to cause lateral displacement during insertion of a distance that is equal to the entire distance necessary to un-shutter a blade opening (typically about 1.8 mm). Over time, these sharp blades having a single point of initial contact begin to deform and cut into the ramp surface which makes movement more difficult as the blades get stuck in divets or scratches at the point of contact. With each successive insertion, more and more force is needed to friction force the camming action and concomitant lateral sliding of the shutters. At some point, the deformity of the ramp surface may make insertion of a plug excessively difficult or even impossible. As this point, the device has reached the end of its useful life.

The foregoing underscores some of the problems associated with conventional TR receptacles. Furthermore, the foregoing highlights the long-felt, yet unresolved need in the art for a TR receptacle that may extend the useful life of the device. Moreover, the forgoing highlights the long-felt, yet unresolved need in the art for a TR receptacle that has an extended service life at a reasonable cost.

SUMMARY OF THE INVENTION

Various embodiments of the present invention overcome various of the aforementioned and other disadvantages associated with prior art TR receptacles and offers new advantages as well.

According to one aspect of various embodiments of the present invention there is provided a TR receptacle having cooperating shutter mechanisms wherein each shutter member extends laterally the length of the plug such that both shutters are contacted by each plug tine.

According to another aspect of various embodiments of the present invention, there is provided a TR receptacle having cooperating shutter mechanisms wherein each shutter member is profiled to fit within slots of a housing such that the shutters can only pivot open when properly aligned.

According to another aspect of various embodiments of the present invention, there is provided a TR receptacle having cooperating shutter mechanisms wherein the shutters are spring biased and can only pivot downwardly when the spring bias is overcome by similar force being exerted by both tines of an electrical plug at the same time.

The invention as described and claimed herein should become evident to a person of ordinary skill in the art given the following enabling description and drawings. The aspects and features of the invention believed to be novel and other elements characteristic of the invention are set forth with particularity in the appended claims. The drawings are for illustration purposes only and are not drawn to scale unless otherwise indicated. The drawings are not intended to limit the scope of the invention. The following enabling disclosure is directed to one of ordinary skill in the art and presupposes that those aspects of the invention within the ability of the ordinarily skilled artisan are understood and appreciated.

BRIEF DESCRIPTION OF THE DRAWINGS

Various aspects and advantageous features of the present invention will become more apparent to those of ordinary skill when described in the detailed description of preferred embodiments and reference to the accompany drawing wherein:

FIGS. 5A-D are various views of a TR receptacle in various stages of use.

DETAILED DESCRIPTION OF A PREFERRED EMBODIMENT

Figure 1C:
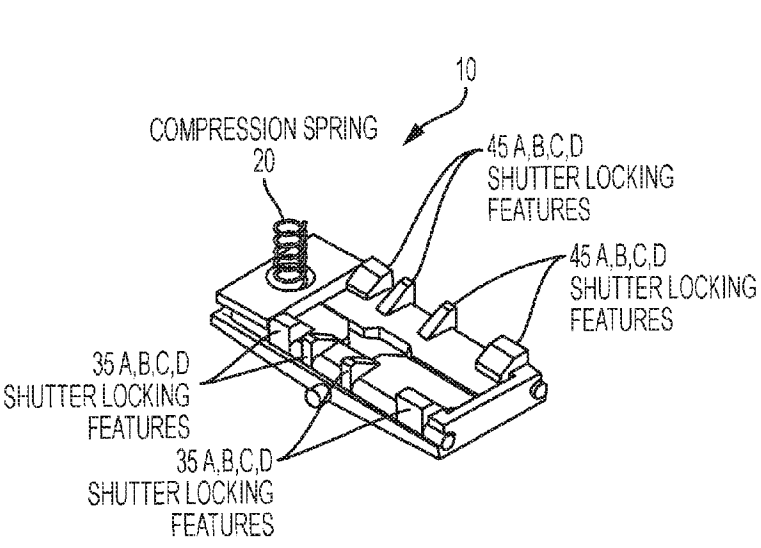
FIGS. 1A-D are various perspective views of a spacer-shutter assembly portion of an embodiment of a TR receptacle according to the invention.
Figure 1D:
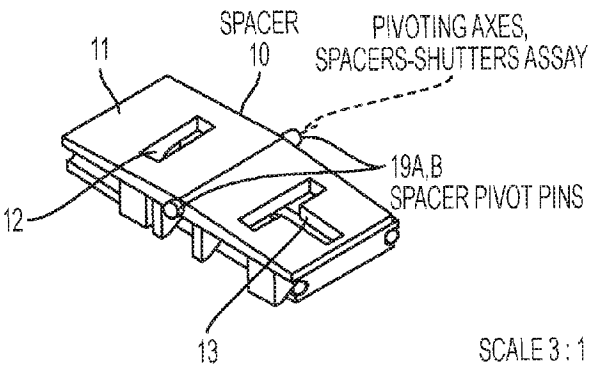
Figure 1A:
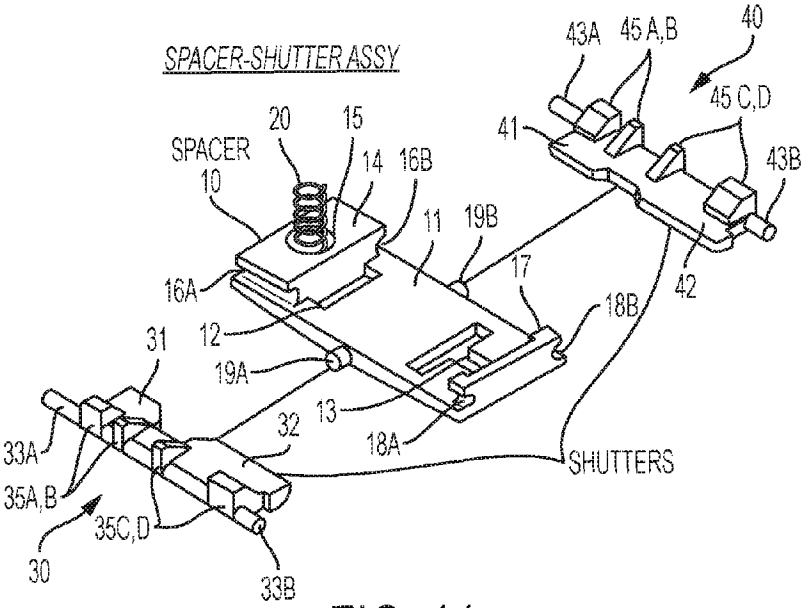
Figure 1B:
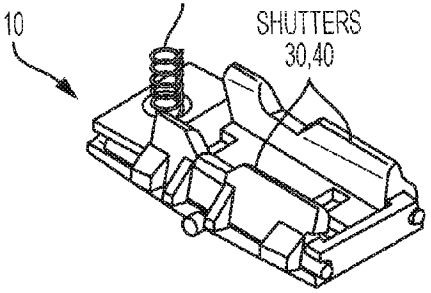
Figure 2A:
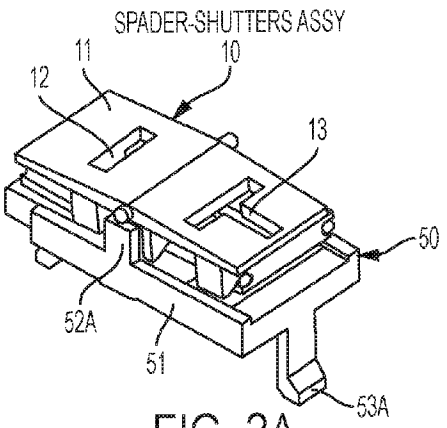
FIGS. 2A-E are various views of a spacer-shutter assembly mounting to a rocker housing for use in an embodiment of a TR receptacle according to the invention.
Figure 2B:
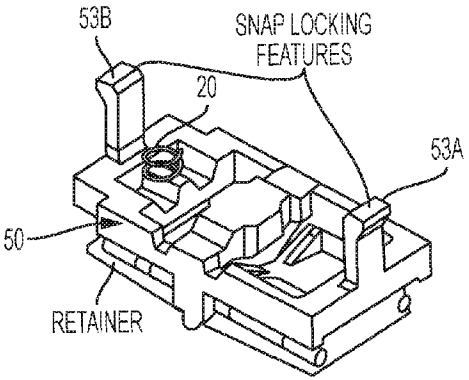
Figure 2D:
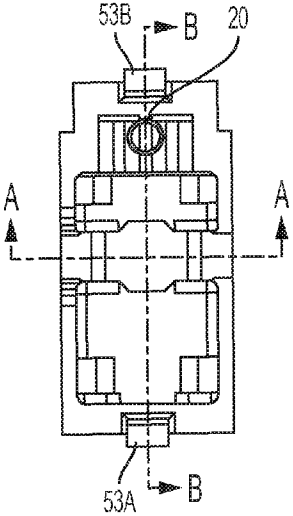
Figure 2E:
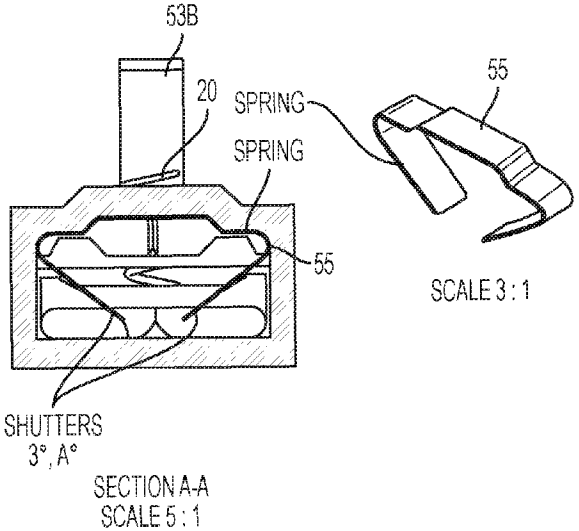
Figure 2C:
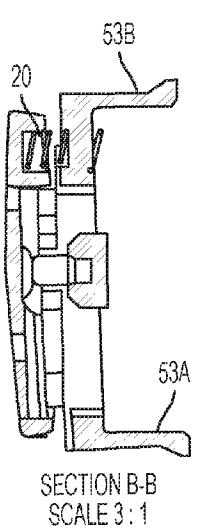
Figure 3B:
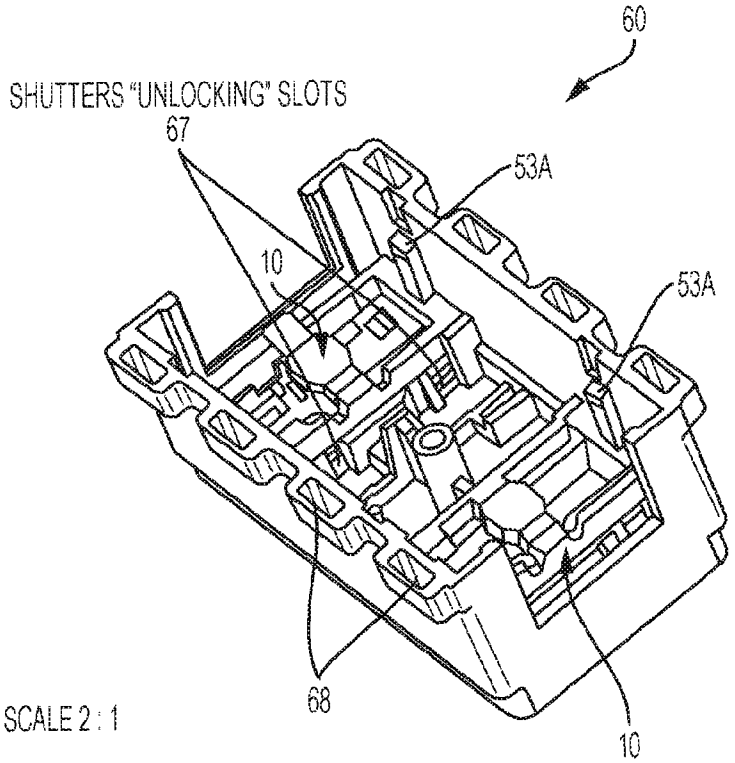
FIGS. 3A-B are perspective views of a receptacle housing for a pair of spacer-shutter assemblies for deployment in a duplex TR wall receptacle according to one embodiment of the invention.
Figure 3A:
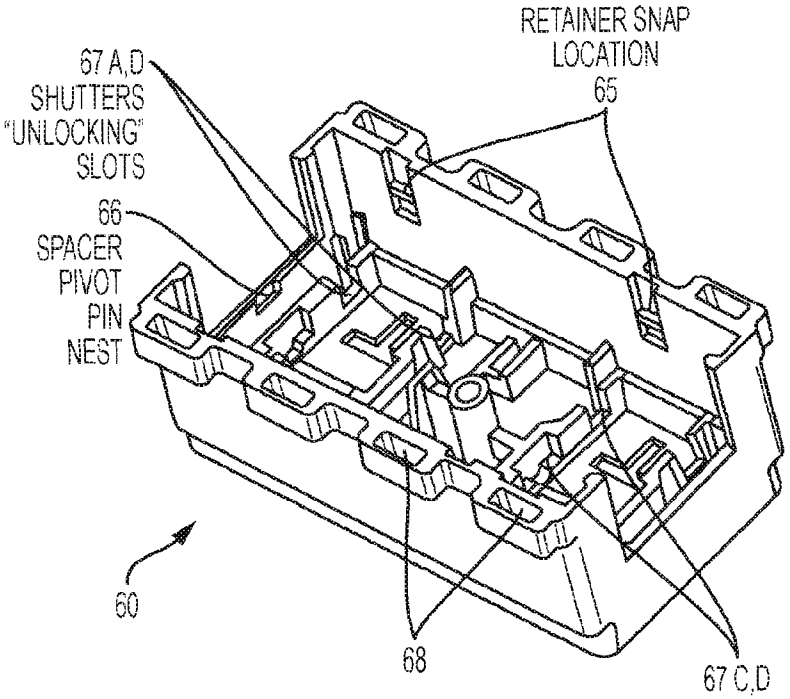
Figure 4C:
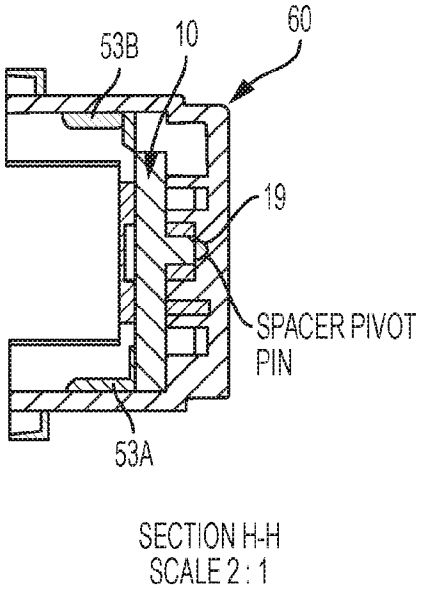
FIGS. 4A-C are various views of an assembled TR sub-assembly deploying a pair of spacer-shutter assemblies for use in a duplex TR wall receptacle. according to one embodiment of the invention.
Figure 4B:
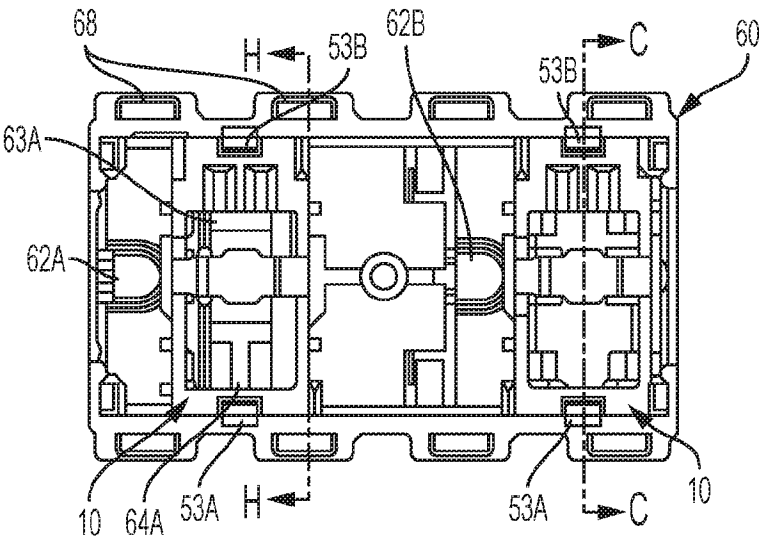
Figure 4A:
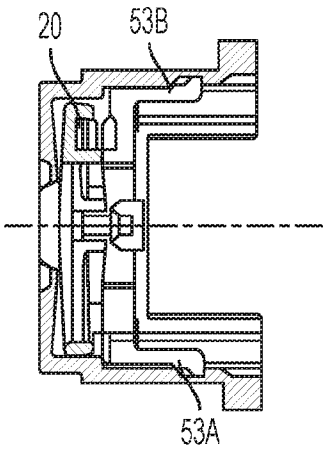

Turning to the Figures, FIGS. 1A-D show the various components of a spacer-shutter assembly 10 portion of the device. As shown, the spacer 10 comprises a generally flat/planar surface 11 having a hot blade opening 12 and a neutral blade opening 13. On the hot blade side of the spacer 10 there is a raised platform, or rocker 14. The rocker 14 includes a spring seat opening 15 and a pair of lateral rod receiving grooves 16A, 16B. On the neutral blade side of the spacer 10 there is a rear flange 17 extending a height about that of the rocker 14. The rear flange 17 also includes a pair of lateral rod receiving groves 18A, 18B. The spacer 10 further includes a pair of pivot pins 19A, B extending from the lateral sides of the spacer 10 near the mid-point of the spacer 10.

The spacer 10 receives a left shutter 30 and right shutter 40 by accepting respective mounting rods 33 A, 33B and 43A, 43B in the corresponding rod receiving grooves 16A, 18A and 16B, 18B. Each shutter 30, 40 includes a hot flange 31, 41 and a neutral flange 32, 42 that serve to block access to the electrical connectors as well as receive the hot and neutral tines of an electrical plug. Each shutter 30, 40 also includes a plurality of projections, or locking features 35A-D, 45A-D. As depicted in the Figures, the locking features comprise a pair of geometrically angled blocks extending from the fixed end of each flange area. The shape and significance of the locking features will be discussed in more detail below.

The spacer-shutter assembly is mounted to a rocker housing 50 to form a spacer-shutter sub-assembly that may in turn be deployed in an electrical receptacle. The rocker housing 50 comprises a frame 51 that includes upwardly extending pivot posts 52A, 52B for supporting the pivot pins 19A, 19B of the spacer 10. The frame 51 also includes a downwardly extending snap lock leg 53A, 53B on each end. A centrally disposed leaf spring 55 with inwardly angled arms is provided to spring bias the shutters 30, 40 in the closed position. As will be appreciated, a force exerted on the doors through either blade opening 12, 13 may overcome the spring bias and allow the doors to pivot into the open position (e.g., where the doors rotate down to uncover openings to the electrical contacts of the receptacle.

The spacer-shutter sub-assembly may then be deployed into an especially configured electrical receptacle housing to provide TR protection. As shown in the Figures, a front cover 60 for a duplex electrical receptacle includes a faceplate portion 61 including a pair of ground blade openings 62 A, 62B, a pair of hot blade openings 63A, 63B, and a pair of neutral blade openings 64A, 64B. The cover 60 defines snap openings 68 for facilitating mating with the back cover of the device (not shown).

On the underside of the faceplate 61 the housing includes two pairs of retainer snap divots 65A,B and 65C,D configured to accept the snap lock legs 53A, B of each rocker 50 deployed in the device. The cover also includes pin nests 66A,B and 66C,C for accepting the pivot pins 19A, 19B of each spacer-shutter sub-assembly. Once positioned in the cover 60, each spacer-shutter sub-assembly is free to pivot up and down in a sea-saw motion. The compression spring 20 serves to keep the sub-assembly pivoted (and the leaf spring 55 keeps the doors closed).

The cover 60 is also configured to include a plurality of shutter unlocking slots 67A-D. The unlocking slots 67A-D are profiled to closely match the geometrical profile of the locking features 35A-D, 45A-D. With this configuration, as shown in the Figures, only when the shutter doors 30, 40 pivot directly in line with the unlocking slots 67A-D can the locking features 35, 45 rotate through the openings. If the doors are offset by more than a degree or two, the locking features 35, 45 bump into the sides of the unlocking slots 67 and cannot rotate past. Thus, the doors 30, 40 cannot rotate open and provide passage for an object entering the hot or neutral openings to reach the electrical contacts of the device.

In operation, if a device is inserted into only one of the hot or neutral openings in the faceplate, the device will contact the doors and cause the sub-assembly to pivot. As continued force begins to overcome the spring bias of the leaf spring, the doors will begin to pivot open only to abut against the side walls surrounding the unlocking slots. The physical blocking of any further rotation of the doors prevents the doors from pivoting enough to uncover any opening that could provide access to the electrical contacts. However, if both tines of an electrical plug enter the hot and neutral openings simultaneously, the sub-assembly does not pivot to either side, but rather ultimately translates into a level position wherein the locking features and unlocking slots are in alignment and the doors are free to continue to rotate into the open position and allow the tines to continued passage to the electrical contacts underneath.

One of ordinary skill will appreciate that the exact dimensions and materials are not critical to the invention and all suitable variations should be deemed to be within the scope of the invention if deemed suitable for carrying out the objects of the invention.

Likewise, one of ordinary skill in the art will readily appreciate that it is well within the ability of the ordinarily skilled artisan to modify one or more of the constituent parts for carrying out the various embodiments of the invention. Once armed with the present specification, routine experimentation is all that is needed to decide the parameters to adjust for carrying out the present invention.

The above embodiments are for illustrative purposes and are not intended to limit the scope of the invention or the adaptation of the features described herein to particular TR receptacles. Those skilled in the art will also appreciate that various adaptations and modifications of the above-described preferred embodiments can be configured without departing from the scope and spirit of the invention. Therefore, it is to be understood that the invention may be practiced other than as specifically described.

What is claimed is:

1. A tamper resistant receptacle comprising:

an electrical receptacle having a faceplate hot and neutral openings and an interior comprising hot and neutral electrical contacts;

a spacer-shutter assembly disposed beneath said faceplate and comprising a spacer and a right shutter and a left shutter, said spacer comprising a generally planar surface having a hot blade opening and a neutral blade opening corresponding to said hot and neutral openings of said faceplate, the spacer including a rocker having a spring seat opening and a pair of lateral rod receiving grooves on a hot blade side of the spacer and a rear flange extending a height about equal to a height of the rocker on a neutral blade side of the spacer, said rear flange including a pair of second lateral rod receiving groves;

a pair of pivot pins extending from the lateral sides of the spacer near a mid-point of the spacer, the left shutter and the right shutter adapted to be received by accepting respective mounting rods in the corresponding rod receiving grooves of said spacer, each of said shutters including a hot flange and a neutral flange that serve to block access to electrical connectors of the devices as well as receive the hot and neutral tines of an electrical plug;

whereby simultaneous insertion of hot and neutral tines of an electrical plug actuate said spacer-shutter assembly to allow said tines to access said electrical contacts.

2. The tamper resistant receptacle of claim 1 wherein each shutter also includes a plurality of projections comprising a pair of geometrically angled blocks extending from a fixed end of said shutter.

3. The tamper resistant receptacle of claim 2 wherein the spacer-shutter assembly is mounted to a rocker housing to form a spacer-shutter sub-assembly that may in turn be deployed in said electrical receptacle.

4. The tamper resistant receptacle of claim 3, wherein the rocker housing comprises a frame that includes upwardly extending pivot posts for supporting the pivot pins of the spacer.

5. The tamper resistant receptacle of claim 4, wherein the frame also includes a downwardly extending snap lock leg on each end of said frame.

6. The tamper resistant receptacle of claim 5, further comprising a centrally disposed leaf spring with inwardly angled arms to spring bias the shutters in the closed position.

* * * * *